US007048273B2

(12) United States Patent
Meckes et al.

(10) Patent No.: US 7,048,273 B2
(45) Date of Patent: May 23, 2006

(54) SYSTEM AND METHOD FOR MONITORING GROUPED RESOURCES

(75) Inventors: David A. Meckes, Allentown, PA (US); James S. Lee, Jr., Phillipsburg, NJ (US); Richard J. Roscioli, Bethlehem, PA (US)

(73) Assignee: Bowe Bell + Howell Company, Durham, NC (US)

( * ) Notice: Subject to any disclaimer, the term of this patent is extended or adjusted under 35 U.S.C. 154(b) by 327 days.

(21) Appl. No.: 10/085,357

(22) Filed: Feb. 28, 2002

(65) Prior Publication Data

US 2003/0160377 A1 Aug. 28, 2003

(51) Int. Cl.
*B65H 7/02* (2006.01)

(52) U.S. Cl. ..... 271/258.01; 271/152; 271/258.04; 271/165

(58) Field of Classification Search ..... 271/256, 271/258.01, 258.04, 265.04, 152–155, 262, 271/263, 3.05, 131, 264, 265.01, 165, 35, 271/132, 265.02
See application file for complete search history.

(56) References Cited

U.S. PATENT DOCUMENTS 3,870,294 A * 3/1975 Donner ..... 271/3.03
3,907,283 A * 9/1975 Miller ..... 271/258.04
4,256,297 A * 3/1981 Prieur et al. ..... 271/207
4,417,351 A * 11/1983 Williamson et al. ..... 377/8
4,478,400 A * 10/1984 Commers ..... 271/3.03
4,535,463 A * 8/1985 Ito et al. ..... 377/8
4,566,683 A * 1/1986 Moore ..... 271/98
4,801,135 A * 1/1989 Povio ..... 271/155
4,919,410 A * 4/1990 Robinson et al. ..... 399/45
4,976,421 A * 12/1990 Kanaya ..... 271/258.01
5,028,041 A * 7/1991 Kobayashi ..... 271/9.03
5,078,379 A * 1/1992 Leisner ..... 271/3.04
5,096,180 A 3/1992 Nagaoka et al.
5,295,678 A * 3/1994 Lindner et al. ..... 271/152
5,347,350 A 9/1994 Nakahata et al.
5,470,050 A * 11/1995 Anma ..... 271/3.03
5,556,252 A * 9/1996 Kuster ..... 414/796.7
5,572,630 A 11/1996 Azuma et al.
5,629,672 A 5/1997 Brown et al.
5,704,246 A 1/1998 Kruger
5,727,135 A 3/1998 Webb et al.
5,806,398 A * 9/1998 Emerson et al. ..... 83/522.21
5,839,015 A * 11/1998 Faguy et al. ..... 399/23
5,853,171 A * 12/1998 Halpenny ..... 271/126
5,915,690 A 6/1999 Surya
5,960,230 A * 9/1999 Peter ..... 399/23
5,961,115 A * 10/1999 Blanck et al. ..... 271/263
6,000,871 A 12/1999 Fisher, Sr.
6,049,775 A 4/2000 Gertner et al.
6,310,692 B1 10/2001 Fan et al.
6,585,344 B1 * 7/2003 Kolodziej ..... 347/19
6,644,649 B1 * 11/2003 Chaume et al. ..... 271/152
6,773,004 B1 * 8/2004 Obregon et al. ..... 270/58.09

(Continued)

*Primary Examiner*—Donald P. Walsh
*Assistant Examiner*—Matthew J. Kohner
(74) *Attorney, Agent, or Firm*—McDermott Will & Emery LLP

(57) ABSTRACT

System and method for monitoring grouped resources. A system and method of monitoring resource units in a stack is provided. The system and method includes providing a group of resource units and determining a thickness of one or more of the resource units. The system and method also includes indicating when the group of resource units reaches a predetermined size after one or more of the resource units has been moved from the group.

28 Claims, 5 Drawing Sheets

U.S. PATENT DOCUMENTS

2002/0105132 A1* 8/2002 Brugger et al. ..... 271/10.01
2004/0061280 A1* 4/2004 Sciurba et al. ..... 271/152
2004/0065996 A1* 4/2004 Ko et al. ..... 271/262
2005/0002679 A1* 1/2005 Phillips et al. ..... 399/23

* cited by examiner

SYSTEM AND METHOD FOR MONITORING GROUPED RESOURCES

TECHNICAL FIELD

The present invention relates generally to systems and methods for indicating resource quantity in document processing systems. More particularly, the present invention relates to a system and method for indicating the quantity of a group of sheets or inserts stored in a hopper for processing by a mail insertion machine.

BACKGROUND ART

Mail insertion machines automatically associate together, process, and place sheet articles (e.g., one or more papers, documents, or envelopes) into envelopes for mass mailing. Thereafter, a mail insertion machine can perform various other operations, such as sealing an envelope, associating stuffed envelopes with an appropriate postage weight category, and grouping or sorting by zip code or in accordance with other criteria. Mail insertion machines typically include a track to move mail pieces along an assembly line for sequential processing by one or more insert stations. Each insert station typically includes one or more hoppers, or containers, for storing sheet articles in a stack until required for processing. A single cycle of operation by an insert station usually includes removing one sheet article from the hopper via a mechanical device and subsequently stuffing the sheet article into an envelope, folding it, marking it, or otherwise preparing it for mailing.

Current mail insertion machines include a sensor to detect a low stack condition and a system for alerting an operator to a low stack condition. It is possible in mail processing for an operator to fail to replenish the sheet article stack despite receiving a low stack condition warning. Such a failure to replenish the sheet article supply can result in an unnecessary and undesirable delay in processing. Additionally, in many known insert stations, sheet articles will fall from the sheet article stack onto the track once the sheet article stack size, or level, is less than a certain size.

One known approach for alleviating these problems is to provide a first sensor for detecting when the quantity of sheet articles is below a first measured size and a second sensor for detecting when the quantity of sheet articles is below a second measured size. When the quantity is depleted until it is below the first measured size, an alert is activated to signal a low stack condition. When the quantity is depleted below the second measured size, an alert is activated to indicate the low stack condition and the insert station can be halted from pulling any more sheet articles from the stack. A disadvantage of this solution is the requirement of two sensors, thus increasing the cost of the machine.

Therefore, it is desired to improve the indication of a low stack condition. It is also desired to indicate to an operator that a sheet article stack height has fallen below a predetermined size. Furthermore, it is desired to halt the processing of any more sheet articles once the hopper has reached a second measured size without the use of a second sensor.

DISCLOSURE OF THE INVENTION

According to one embodiment, a method of monitoring resource units in a stack is provided. The method includes providing a group of resource units and determining a thickness of one or more of the resource units. The method also includes indicating when the group of resource units reaches a predetermined size after one or more of the resource units has been moved from the group.

According to a second embodiment, a method of monitoring resource units in a group of resource units is provided. The method includes detecting a size of resource units in a group of resource units. The method also includes calculating, based upon the thicknesses of at least one of the resource units, when the group of resource units reaches a predetermined size after one or more resource units has been moved from the group.

According to a third embodiment, a method for controlling removal of sheet articles from a stack is provided. The method includes detecting a level of a stack of sheet articles and removing one or more sheet articles from the stack. Furthermore, the method includes determining a thickness of at least one of the sheet articles removed from the stack and indicating when the stack of sheet articles reaches a predetermined level. Still furthermore, the method includes stopping removal of sheet articles from the stack.

According to a fourth embodiment, a system for monitoring resource units in a stack is provided. The system includes a container for containing a group of resource units. The system also includes a device for determining a thickness of one or more of the resource units. Furthermore, the system includes an indicator for indicating when the group of resource units reaches a predetermined size after one or more of the resource units has been moved from the group.

According to a fifth embodiment, a system for monitoring resource units in a group of resource units is provided. The system includes a measurement detector for detecting a size of resource units in a group of resource units. Furthermore, the system includes a controller for calculating, based upon the thickness of at least one of the resource units, when the group of resource units reaches a predetermined size after one or more resource units has been moved from the group.

According to a sixth embodiment, a system for controlling removal of sheet articles from a stack is provided. The system includes a measurement detector for detecting a level of a stack of sheet articles. The system also includes a mechanical device for removing one or more sheet articles from the stack. Furthermore, the system includes a means for determining a thickness of at least one of the sheet articles removed from the stack. Still furthermore, the system includes an indicator for indicating when the stack of sheet articles reaches a predetermined level and selectively stopping removal of sheet articles from the stack.

According to a seventh embodiment, a computer program product for monitoring resource units in a stack is provided. The computer program product comprising computer-executable instructions embodied in a computer-readable medium for performing steps. The steps include detecting a size of resource units in a group of resource units. Furthermore, the steps include calculating, based upon the thicknesses of at least one of the resource units, when the group of resource units reaches a predetermined size after one or more resource units has been moved from the group.

Accordingly, it is an object to provide a novel system and method for the detection and processing of grouped resource units, particularly for stack documents such as inserts for mail processing.

Some of the objects having been stated and which are achieved in whole or in part, other objects will become evident as the description proceeds when taken in connection with the accompanying drawings as best described hereinbelow.

BRIEF DESCRIPTION OF THE DRAWINGS

Exemplary embodiments of the invention will now be explained with reference to the accompanying drawings, of which.

DETAILED DESCRIPTION OF THE INVENTION

Figure 1:
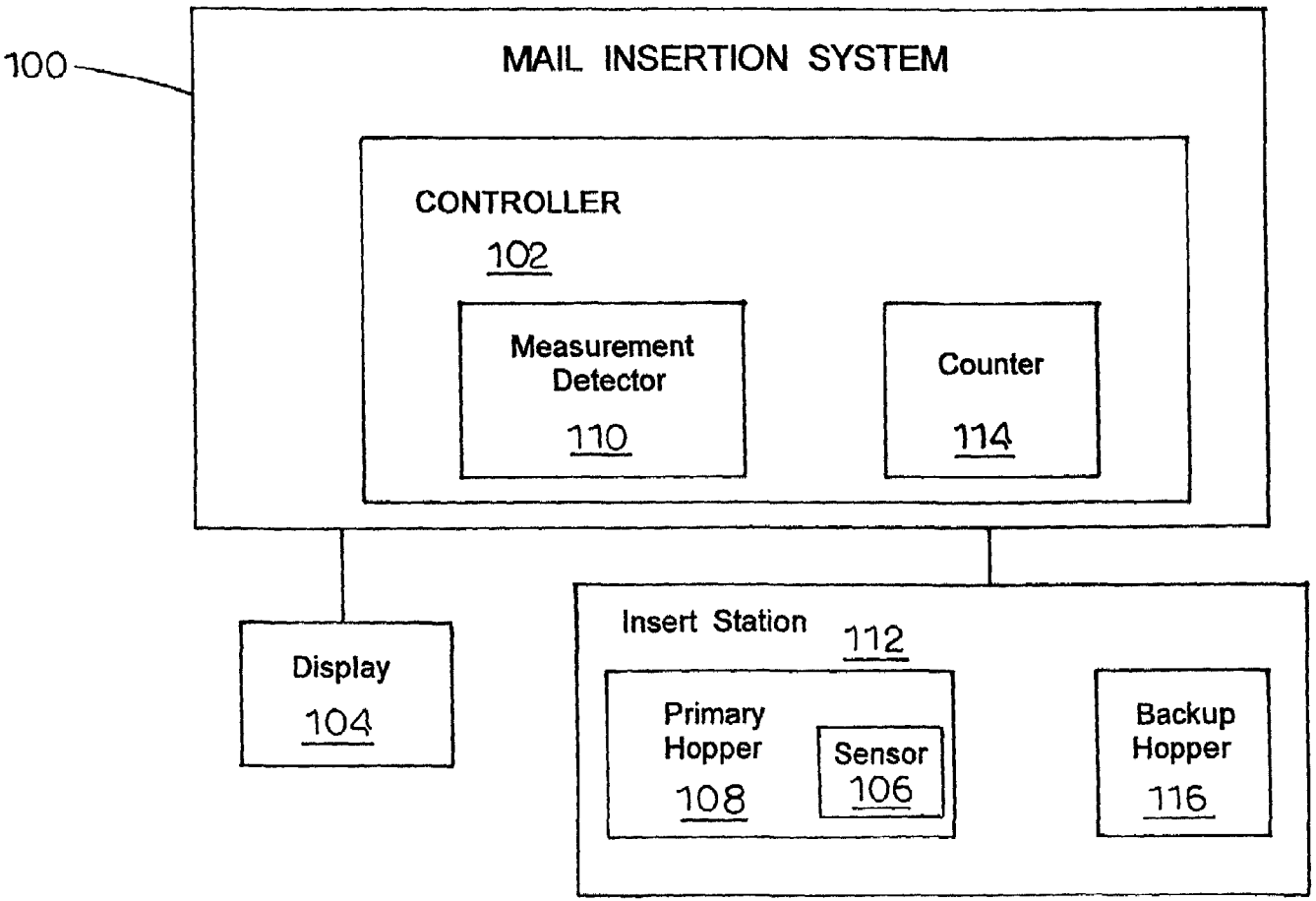
FIG. 1 is a schematic diagram of a mail insertion system according to a preferred embodiment.

The invention now is described more fully hereinafter with reference to the accompanying drawings, in which preferred embodiments of the invention are shown. This invention can, however, be embodied in many different forms and should not be construed as limited to the embodiments set forth herein; rather, these embodiments are provided so that this disclosure will be thorough and complete, and will fully convey the scope of the invention to those skilled in the art.

As will be appreciated by one of skill in the art, the present invention can be embodied as a method, system, or computer program product. Accordingly, the present invention can take the form of an entirely hardware embodiment, an entirely software embodiment, or an embodiment combining software and hardware aspects. Furthermore, the present invention can take the form of a computer program product on a computer-readable storage medium having computer-readable program code means embodied in the medium. Any suitable computer readable medium can be utilized including hard disks, CD-ROMs, optical storage devices, or magnetic storage devices.

The invention is described below with reference to flowchart illustrations of methods, apparatus (systems), and computer program products according to the invention. It will be understood that each block of the flowchart illustrations, and combinations of blocks in the flowchart illustrations, can be implemented by computer program instructions. These computer program instructions can be loaded onto a general purpose computer, special purpose computer, or other programmable data processing apparatus to produce a machine, such that the instructions which execute on the computer or other programmable data processing apparatus create means for implementing the functions specified in the flowchart block or blocks. These computer program instructions can also be stored in a computer-readable memory that can direct a computer or other programmable data processing apparatus to function in a particular manner, such that the instructions stored in the computer-readable memory produce an article of manufacture including instruction means which implement the function specified in the flowchart block or blocks. The computer program instructions can also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions specified in the flowchart block or blocks.

Accordingly, blocks of the flowchart illustrations support combinations of means for performing the specified functions, combinations of steps for performing the specified functions and program instruction means for performing the specified functions. It will also be understood that each block of the flowchart illustrations, and combinations of blocks in the flowchart illustrations, can be implemented by special purpose hardware-based computer systems which perform the specified functions or steps, or combinations of special purpose hardware and computer instructions.

As will readily be appreciated by those of skill in the art, the inventive apparatus and methods can be applied to several types of machines requiring the indication of the size of a group of resource units. As described herein, the disclosed apparatus and methods can be applied to mail insertion machines for the indication of the quantity of a sheet article stack with respect to a measurement. Furthermore, the disclosed apparatus and methods can be applied to copiers, printers, and facsimile machines requiring resource unit monitoring and other such machines requiring resource size indication. Additionally, the disclosed apparatus and methods can be applied to machines requiring other size indication such as an indication of the supply of toner.

The disclosed apparatus and methods are described with regard to sheet articles in a mail insertion machine. As will readily be appreciated by those of skill in the art, the disclosed apparatus and methods can be applied to several types of sheet articles that are collected in a group and moved from the group one or more at a time.

Referring to FIG. 1, a schematic diagram of a mail insertion system 100 according to a preferred embodiment is illustrated. Mail insertion system 100 includes a controller 102 for operating and transmitting information to and receiving information from a touch screen display 104 and a sensor 106. Additionally, controller 102 can be used for operating and monitoring various other components of the mail insertion system 100. Display 104, described in more detail below, visually displays information to an operator and allows the operator to provide input to the mail insertion system 100. Sensor 106, described in more detail below, indicates whether the quantity of inserts stored in a primary hopper 108 is below a certain measurement. As referred to herein, a sheet article is a single resource unit among several resource units, or sheet articles, stored in primary hopper 108. As described in more detail below, the present invention can be stored in the components of controller 102, either within internal memory or on internal disk storage. The present invention can also be stored on computer readable media.

Controller 102 includes a measurement detector 110 operatively connected to sensor 106 (by or through a cable or another signal transmission device known to those of skill in the art) for detecting whether the level of a group of sheet articles in primary hopper 108 of an insert station 112 is below the measurement indicated by sensor 106. Controller 102 also includes a counter 114 for counting the number of sheet articles moved from primary hopper 108 while the level of the group of sheet articles is below the measurement indicated by measurement detector 110. When the number of sheet articles moved from primary hopper 108 is equal to a predetermined number, display 104 functions as an indicator for indicating that the level is equal to or less than a second measurement. The functions of measurement detector 110, counter 114, and display 104 in a measurement of the level of the group of sheet articles in primary hopper 108 will be described in further detail below.

In a preferred embodiment, controller 102 controls the operation of a gripper arm (not shown) for removing sheet articles one or more at a time from the sheet article stack in primary hopper 108. The gripper arm pulls sheet articles from the bottom of the sheet article stack. In this embodiment, the gripper arm also measures the thickness of the sheet article and transmits this information to controller 102 as sheet articles are pulled from the stack. When controller 102 detects that five sheet articles have been pulled in a row with the same thickness, the measured thickness of the sheet article is calibrated as the measure of the thickness of these sheet articles. Controller 102 provides counter 114 indication of the removal of a sheet article from primary hopper 108. Other suitable means for removing a sheet article from the sheet article stack as known to those of skill in the art can be used.

Other than primary hopper 108, mail insertion system 100 in a preferred embodiment includes five hoppers (other than primary hopper 108) including a backup hopper 116 functioning as a backup to primary hopper 108. Sheet articles can be pulled from backup hopper 116 in the case of a sheet article shortage, hopper fault, or otherwise as described below. In this embodiment, backup hopper 116 stores sheet articles identical to those sheet articles in primary hopper 108. While the four hoppers in addition to primary hopper 108 and backup hopper 116 are not shown in FIG. 1, it is envisioned that any suitable number of backup hoppers could be utilized.

A method for indicating the level of a group of sheet articles in a mail insertion machine includes detecting whether the level of the group of sheet articles is below a predetermined level. In the embodiment shown in FIG. 1, resource detection can be performed by measurement detector 110. Measurement detector 110 receives input from sensor 106 for detecting whether the level of the group of sheet articles is below a predetermined level. Furthermore, measurement detector 110 indicates to counter 114 when the level of the sheet article group is below the measurement by sensor 106.

Figures 2, 3, 4:
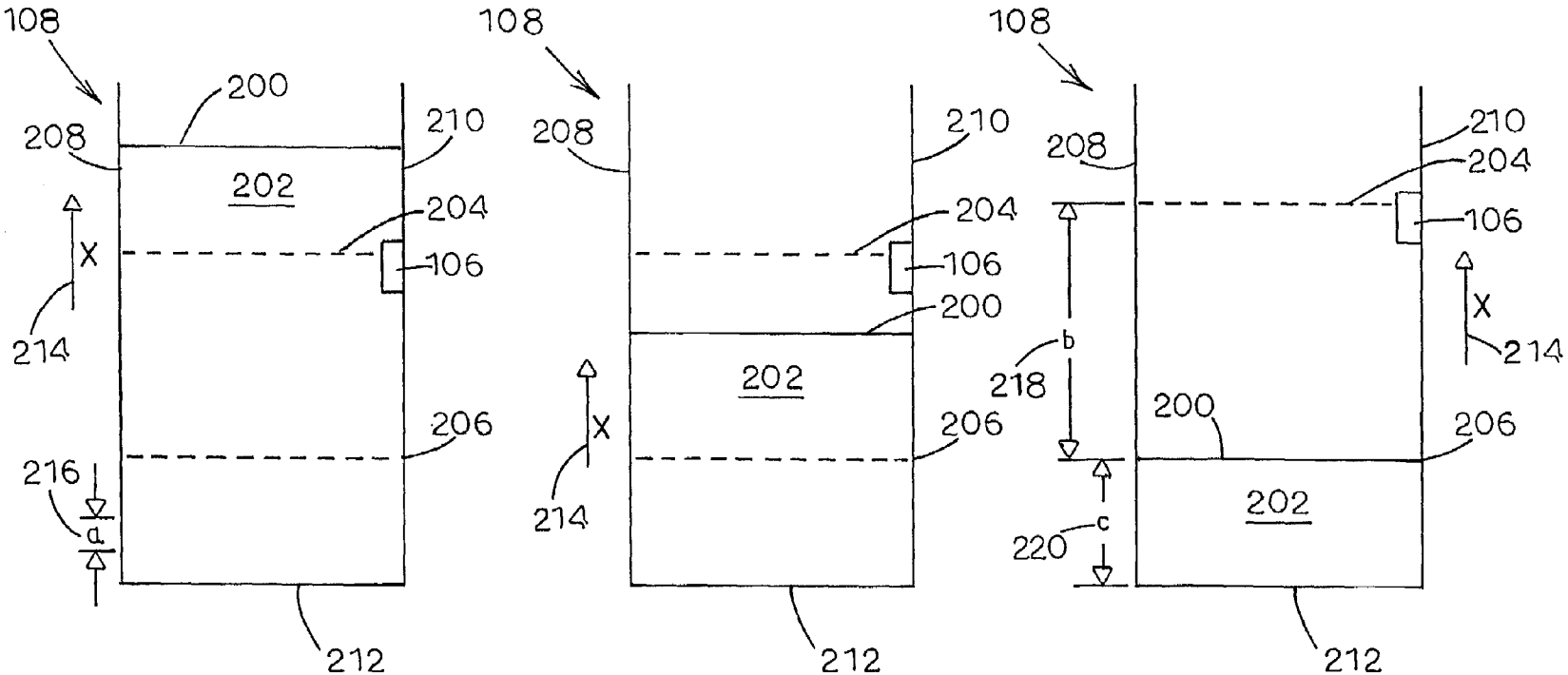
FIG. 2 is a schematic diagram of a cross-sectional view of an exemplary hopper according an embodiment, wherein the insert stack is above a predetermined level.
FIG. 3 is a schematic diagram of a cross-sectional view of an exemplary hopper according to an embodiment, wherein the insert stack is below a predetermined level and above a minimum level.
FIG. 4 is a schematic diagram of a cross-sectional view of an exemplary hopper according to an embodiment, wherein the insert stack is equal to a minimum level.

Referring to FIGS. 2–4, schematic diagrams are illustrated of a cross-sectional view of an exemplary hopper, generally designated 108, having sensor 106 for detecting a top level 200 of a sheet article stack 202. FIGS. 2–4 show top level 200 at various heights with respect to a measured level 204 and a predetermined level 206. Measured level 204 is determined by sensor 106. Predetermined level 206 is the measured quantity of sheet article stack 202 as determined by controller 102 provided with measured level 204 and an indication of the removal of sheet articles. Hopper 108 includes adjustable opposing sides 208 and 210 for providing side support to sheet article stack 202. Sheet articles within sheet article stack 202 rests flat against one another on a base 212 of hopper 108. Sheet articles are stacked in a direction x 214.

Referring now specifically to FIG. 2, the exemplary schematic diagram illustrates sheet article stack 202 wherein top level 200 is above measured level 204. The thickness of a single insert is approximately a distance a 216 in a direction x 214. Level 200 is reduced a distance equal to distance a 216 each time a cycle is run by insert station 112 requiring a sheet article from primary hopper 108.

Sensor 106 is mounted on primary hopper 108 a distance from base 212 for detecting that top level 200 is either above or below the distance. In this embodiment, sensor 106 is a switch type sensor. Sensor 106 is activated to indicate that top level 200 is above measured level 204 when sheet article stack 202 presses against sensor 106. As shown in FIG. 2, top level 200 is above sensor 106. Thus, measurement detector 110 detects that top level 200 is above measured level 204. Once enough inserts are pulled from sheet article stack 202 so that level 200 is below measured level 204, sensor 106 is de-activated and measurement detector 110 detects that level 200 is below measured level 204.

Referring now to FIG. 3, the exemplary schematic diagram illustrates sheet article stack 202 wherein level 200 is below measured level 204 and above predetermined level 206. As described in more detail below, when level 200 is between measured level 204 and predetermined level 206, the operator is alerted to a low stack condition via display 104.

Referring now to FIG. 4, the exemplary schematic diagram illustrates sheet article stack 202 wherein level 200 is equal to predetermined level 206. Predetermined level 206 is below measured level 204 a distance b 218. Predetermined level 206 is above base 212 a distance c 220. As described in more detail below, when level 200 is equal to predetermined level 206, the operator is alerted to another low stack condition via display 104. The disclosed apparatus and methods can be used to determine when level 200 has been reduced to a quantity approximately equal to predetermined level 206 as described in further detail below.

As discussed above, sensor 106 in this embodiment is a switch type sensor. Alternatively, a retro-reflective optical sensor can be used, as well as other suitable sensors known to those of skill in the art.

A method for indicating the level of a group of sheet articles in a mail insertion machine includes counting the number of sheet articles moved from the group of sheet articles while the level is below the sensor measurement. Such counting can be performed by counter 114. Counter 114 receives input from measurement detector 110 for counting the number of sheet articles removed from sheet article stack 202 when level 200 is below measured level 204, as shown and described with regard to FIGS. 2–4.

Counter 114 provides an indication when level 200 is equal to predetermined level 206. In this embodiment, when this occurs insert station 112 is disabled from pulling sheet articles from primary hopper 108, and insert station 112 is enabled to pull sheet articles from backup hopper 116. In an alternate embodiment without a backup hopper, the mail insertion system 100 can be disabled when this occurs. Furthermore, in another embodiment operator can be provided with an additional more urgent low stack condition warning.

Display 104 allows an operator to monitor and manage the operation of mail insertion system 100. An operator is provided with the ability to turn on and off hoppers associated with insert stations via interaction with display 104. Display 104 provides a visual indication of the operation of mail insertion system 100 to an operator. An operator can enter data via display 104 by depressing the display screen (not shown) at the appropriate space on its surface using a finger, pen, or other suitable device known to those of skill in the art.

Figure 5:
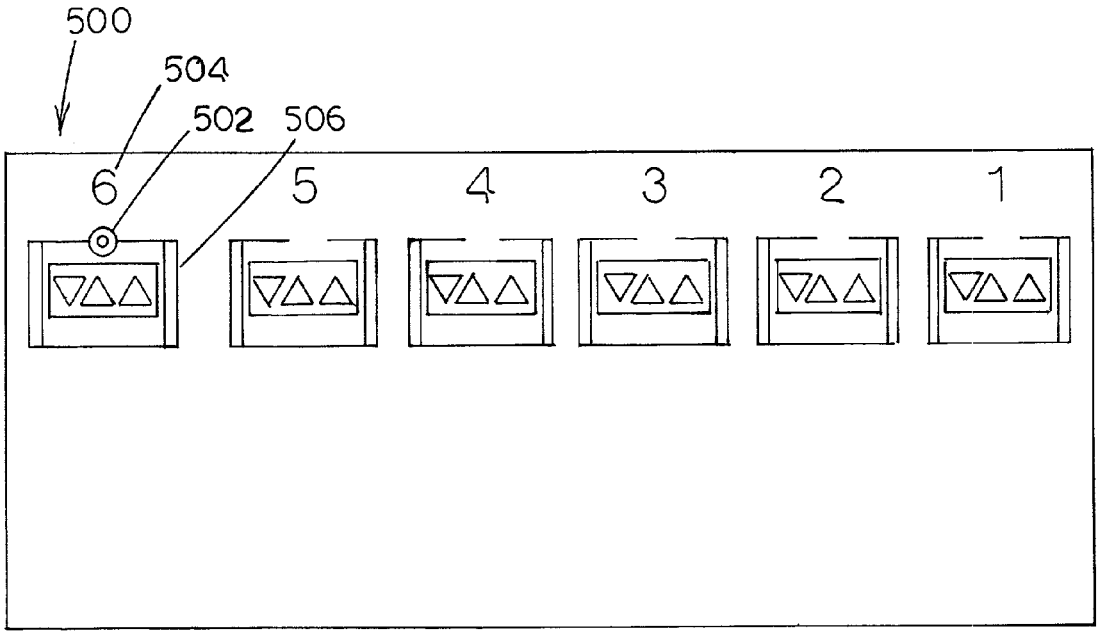
FIG. 5 is a schematic diagram of a display screen indicating a low stack condition.

Referring to FIG. 5, a schematic diagram of a display screen, generally designated 500, indicating a low stack condition is illustrated. A low stack condition is indicated by low stack condition icon 502. Icon 502 condition flashes on and off when the stack height or level 200 is between measured level 204 and predetermined level 206 to alert the operator to a low stack condition. When level 200 is equal to predetermined level 206 and lower, icon 502 remains on to alert operator to such an urgent low stack condition. A "six" number icon 504 positioned above the low stack condition icon 502 and an associated hopper icon 506 indicates to the operator that these icons are associated with hopper number six.

Figure 6:
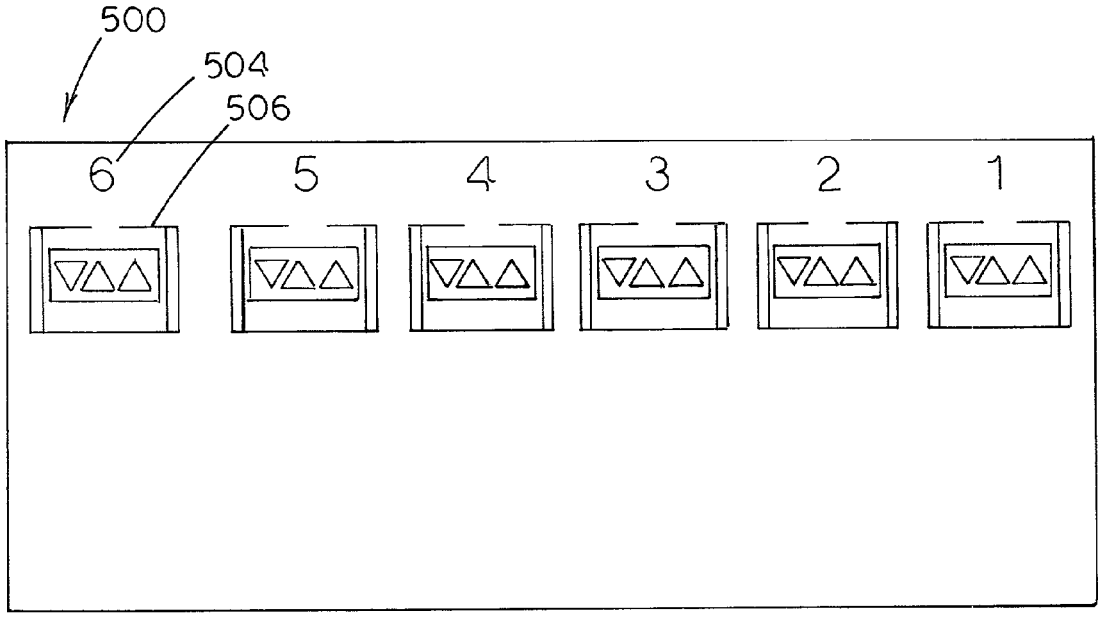
FIG. 6 is a schematic diagram of a display screen indicating a stack condition above a predetermined level.

Referring to FIG. 6, a schematic diagram of display screen, generally designated 500, indicating a stack condition above measured level 204 is illustrated. This condition is indicated by the absence of low stack condition icon 502 (shown in FIG. 5).

Instead of a touch screen display, a conventional display, mouse, and keyboard can be used to allow an operator to provide input to the mail insertion system. With the mouse, the operator can move a pointer on the display to an area displaying an object. By pressing and releasing a button on the mouse while the pointer is in the area displaying the object or icon, the operator "activates" the icon for input. With the keyboard, the operator can enter commands to the mail insertion system. Alternatively, any other known suitable device for displaying or providing input to the mail insertion system as known to those of skill in the art can be used.

Figure 7:
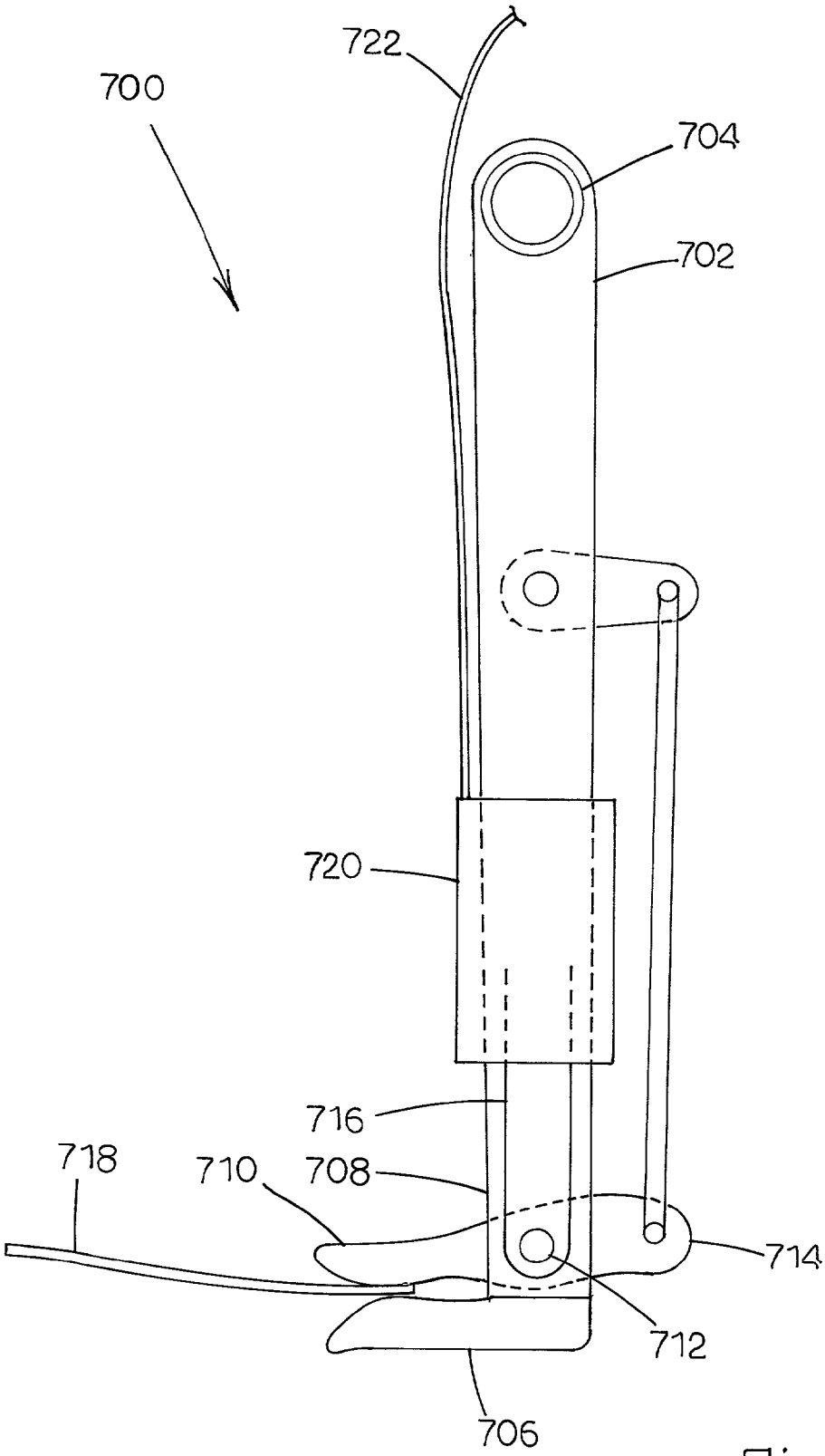
FIG. 7 is a diagram of a gripper arm for removing sheet articles one or more at a time from a sheet article stack in a hopper.

Referring to FIG. 7, a diagram of a conventional gripper arm, generally designated 800, for removing sheet articles one or more at a time preferably from the bottom of a sheet article stack in a hopper is illustrated. An end 702 of gripper arm 700 is attached to and pivots on an axis 704. An actuator (not shown) moves gripper arm 700 about axis 704. a pivotable gripper jaw 706 is attached at an end 708 distal to end 702. Opposite gripper jaw 706 is a gripper jaw 710 pivotally connected to an axis 712. A rear extension 714 functions to move gripper jaw 710 about axis 712 via an actuator (not shown). Details of this mechanism are well known to those of skill in the art.

Attached to axis 712 is a lever 716 forming a movement transition-part. In the position shown in FIG. 7, lever 716 extends substantially in a direction along the length of gripper arm 700. Thus, it is oriented in a predetermined angle of, e.g., 90 degrees with respect to the direction of the length of gripper jaw 710. In operation, a sheet articles 718 can be engaged by gripper jaws 706 and 710, sheet article 718 having been drawn off from the lower end of a stack. Sheet article 718, by being interposed between gripper jaws 706 and 710, causes a pivot position of gripper jaw 710. The pivot position of gripper jaw 710 is detected by a detector 720 attached to gripper arm 700. Detector 720 can be attached to controller 102 (shown in FIG. 1) via a line 722 for transmitting data indicating the pivot position of gripper jaw 710. This data can be used by controller 102 for determining the thickness of sheet article 718 as well known to those of skill in the art. Alternatively, other suitable processes known to those of skill in the art can be used for determining the thickness of sheet articles.

Figure 8:
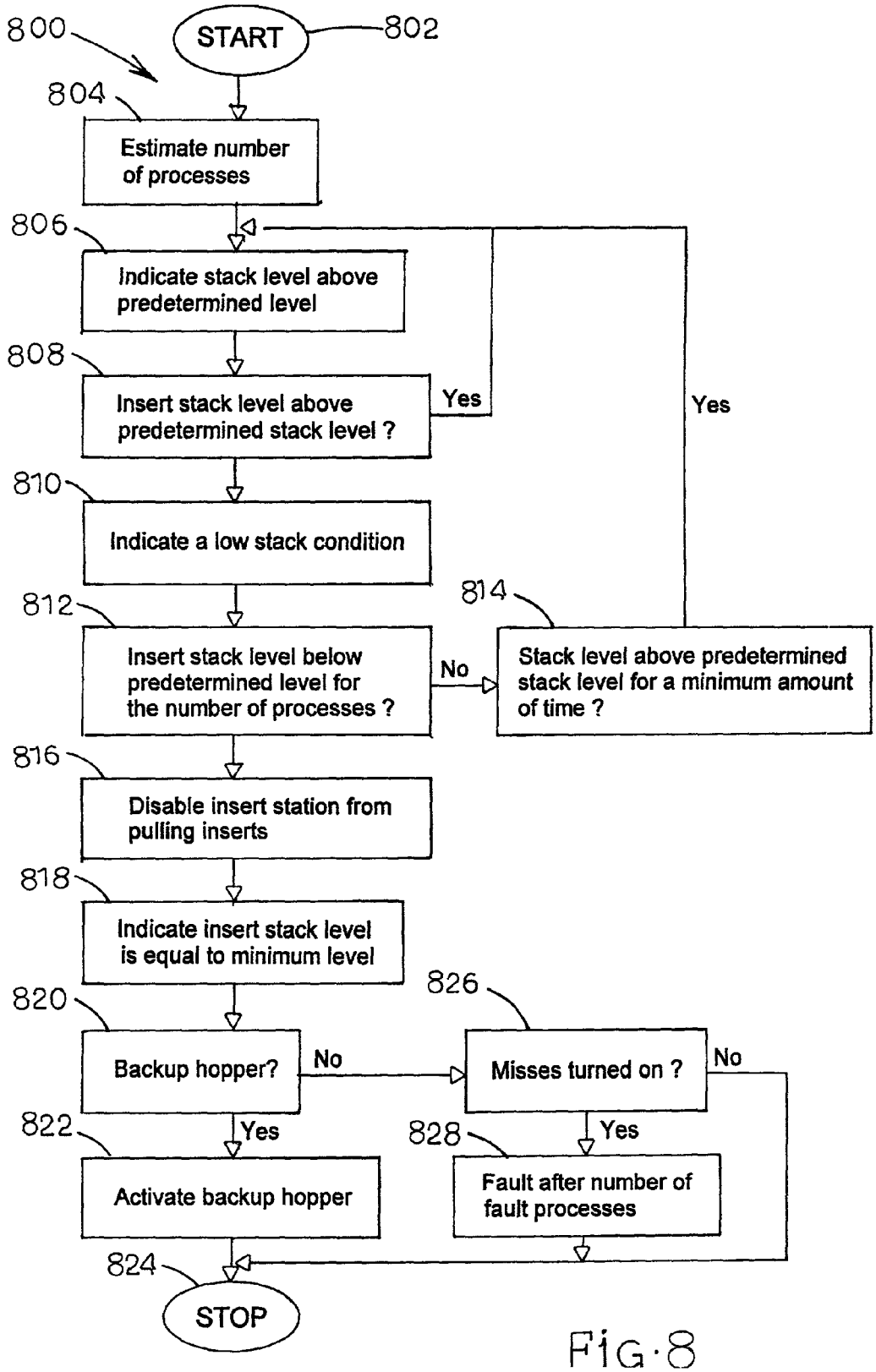
FIG. 8 is a flow chart illustrating a process for resource management in a machine according to one embodiment.

Referring now to FIG. 8, a flow chart, generally designated 800, is provided which illustrates a process for indicating the size or level of a group of sheet articles in a mail insertion machine according to a preferred embodiment of this invention. This indication of the level of the group of sheet articles can be performed by a computer system or controller, which can be local or remote. In this embodiment, sheet article level indication is performed by measurement detector 110 and counter 114 of controller 102 as shown in FIG. 1, and display 104 serving as a visual indication to the operator as shown in FIGS. 5 and 6. The process begins at the step indicated by reference numeral 802.

In step 804, controller 102 estimates the number of sheet articles that can be removed from hopper 108 until level 200 is equal to predetermined level 206. After determining when the level of the group of sheet articles is equal to the sensor measurement, the number of sheet articles required before reaching predetermined level 206 can be estimated if controller 102 is provided the following information: sheet article thickness (distance a 216 shown in FIG. 2); and the distance between measured level 204 and predetermined level 206 (distance b 218 shown in FIG. 4). As referred to herein, cycle is a sequence run by an insert station 112 or any other component of mail insertion system 100 that depletes one sheet article from hopper 108, thereby reducing level 200 a distance equal to the thickness of one sheet article. Therefore, provided the number of cycles executed, the time when level 200 reaches predetermined level 206 can be determined. In this embodiment, sheet article thickness is calibrated by mail insertion system 100. In one embodiment, the gripper arm can determine the thickness of the sheet article. In another embodiment, sheet article thickness can be provided to counter 114 through other suitable means known to those of skill in the art.

The number of sheet articles removed to reduce the sheet article stack height a distance can be determined by the following equation, wherein C is the number of sheet articles, D is the distance the stack height is reduced, and T is the thickness of an sheet articles:

$$C = \frac{D}{T}$$

In this embodiment, the distance estimated is for a distance b 218 (shown in FIG. 4), the distance separating measured level 204 and predetermined level 206. Alternatively, the number of sheet articles, C, can be provided to counter 114 through other suitable means known to those of skill in the art, such as by programming it into the system by an operator.

In step 806, it is initially indicated to the operator that level 200 is above measured level 204 by the absence of low stack condition icon associated with the hopper. The absence of the low stack condition icon indicates to an operator that the sheet article supply in the stack is sufficient.

In step 808, a determination is made as to whether level 200 is above measured level 204. As stated above, measurement detector 110 can determine whether level 200 is above measured level 204. If level 200 is above measured level 204, the next step is step 806, wherein it is indicated to the operator that level 200 is above measured level 204 by the absence of low stack condition icon associated with the hopper. Otherwise, the operator is provided an indication of a low stack condition via the display of a low stack condition icon as described above (step 810).

In step 812, a determination is made as to whether level of the sheet articles has been below the predetermined level for the calculated number of sheet articles for removal as described above. As described above, counter 114 determines whether the number of sheet articles removed is equal to the predetermined number of sheet articles for removal while the sheet article stack level is below the predetermined height. In this embodiment, if level 200 is below the measured level 204 before the removal of the predetermined number of sheet articles, the next step is step 814. Alternatively, it can then be determined that level 200 is above measured level 204, and the next step is step 806. If it is determined level 200 is below the measured level 204 for the removal of the predetermined number of sheet articles, the next step is step 816, as described below.

In step 814, a determination is made as to whether level 200 is above the predetermined stack height for a minimum amount of time. In this embodiment, the minimum amount of time is five seconds. This feature provides a safeguard to prevent an indication is above the measured level 204 if the sensor erroneously detects such a condition. For example, the operator can add sheet articles to hopper 108, and thus sensor 106 briefly detects the sheet articles as they are lowered past. This feature assures that the stack has been replenished and not just loaded to a level below measured level 204. If level 200 is above the measured level 204 for the minimum amount of time, the next step is step 806 as described above. Otherwise, the next step is step 816, as described below.

In step 816, insert station 112 is disabled from pulling sheet articles from hopper 108. Thus, it is estimated that level 200 is approximately equal to predetermined level 206. The operator is alerted via the display as described above (step 818).

In step 820, a determination is made as to whether there is a backup hopper for the primary hopper. If there is a backup hopper for the primary hopper, the backup hopper is enabled (step 822), and then the flow process stops (step 824). Otherwise, it is determined whether the "miss" feature is turned on (step 826). A miss, as referred to herein, occurs when the gripper arm fails to remove a sheet article, or "misses" a sheet article on an attempt to remove the sheet article.

If misses are turned on, the mail insertion system will fault after a predetermined number of fault cycles (step 828), and the next step is step 824. In this embodiment, the operator can set the number of fault cycles for execution before fault to one to three cycles. If the misses are not turned on, the mail insertion system will continue to cycle, and the next step is step 824.

The disclosed apparatus and methods can be implemented in a variety of communications environments including a Local Area Network (LAN) and Wide Area Network (WAN) environments. The disclosed apparatus and methods can be implemented in communications environments utilizing TCP/IP communications protocol, such as the Internet, and environments utilizing SNA protocol. Hardware for implementing the disclosed apparatus and methods is generally consistent with typical personal computing equipment, and does not generally require special environmental conditions other than a typical office environment. In one exemplary embodiment, the disclosed apparatus and methods can be implemented on an International Business Machines™ or IBM™-compatible personal computer and software capable of supporting a thin wire Ethernet TCP/IP environment. The server can be based on an Intel™ processor and having sufficient memory to perform all functions efficiently. In one embodiment, the printer is suitable for text and color graphical report printing; automatic back-up capability for data and configuration files; and trackball or mouse support. The disclosed apparatus and methods can be implemented via other computing device, including, but not limited to, mainframe computing systems and mini-computers.

The disclosed methods can be written in various computer languages including, but not limited to, C++, Smalltalk, Java, and other conventional programming languages such as BASIC, FORTRAN, and COBOL.

Computer readable program code means is provided for receiving processing system operation related information from each of a plurality of mail insertion devices, and for representing each of the mail insertion devices as an interactive icon on a display connected to a data processing system. Each interactive icon has indicia associated therewith which displays the operation related information for a respective mail insertion device and changes appearance in response to a change in the operation related information. Computer readable program code means is provided for displaying selective operation related information about a respective mail insertion device in response to user actions, and for displaying operation related information for each mail insertion device in real time. Computer readable program code means is also provided for adding, deleting, and modifying the location and appearance of the interactive icons.

Certain inventive concepts involved here relate to a computer program product, for causing the processor serving as controller 102 to implement the group resource monitoring techniques described above. Such a computer program product comprises computer-executable instructions and/or associated data for causing a programmable processor to perform the sequence of operations involved in the resource monitoring. The computer-executable instructions are carried on or embodied in computer-readable medium.

The term "computer-readable medium" as used herein refers to any medium that participates in providing instructions to processor of the controller 102 for execution. Such a medium may take many forms, including but not limited to, non-volatile media, volatile media, and transmission media. Non-volatile media include, for example, optical or magnetic disks. Volatile media include dynamic memory, such as the main memory of a personal computer, a server or the like. Transmission media include coaxial cables; copper wire and fiber optics, including the wires that for the bus within a computer. Transmission media can also take the form of electric or electromagnetic signals, or acoustic or light waves such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, and EPROM, a FLASH-EPROM, any other memory chip or cartridge, a carrier wave transporting data or instructions, or any other medium from which a computer can read. Various forms of computer readable media may be involved in carrying one or more sequences of one or more instructions to the processor for execution.

In alternative embodiments, hard-wired circuitry may be used in place of or in combination with software instructions to implement the invention. Thus, embodiments of the invention are not limited to any specific combination of hardware circuitry and software.

It will be understood that various details of the invention can be changed without departing from the scope of the invention. Furthermore, the foregoing description is for the purpose of illustration only, and not for the purpose of limitation—the invention being defined by the claims.

What is claimed is:

1. A method of monitoring resource units in a group, comprising:

(a) detecting a first level of a group of resource units;

(b) identifying a predetermined second level of the group of resource units, wherein the predetermined second level is lower than the first level;

(c) removing one or more of the resource units from the group; and (d) determining when the group of resource units reaches the predetermined second level after one or more of the resource units has been removed from the group and based upon a thickness of one or more of the resource units and a distance between the first level and the second level.

2. The method of claim 1 wherein the group of resource units is a stack of sheet articles in a mail insertion system.

3. The method of claim 1 further comprising determining a thickness of one or more of the resource units prior to removal of one or more resource units from the group.

4. The method of claim 1 wherein detecting the first level of the group of resource units includes providing a sensor for determining when the first level of the group of resource units is less than a predetermined third level.

5. The method of claim 1 wherein determining when the group of resource units reaches the predetermined second level further comprises determining the thickness of one or more of the resource units by measuring an actual thickness of one or more of the resource units as one or more of the resource units are removed from the group.

6. The method of claim 1 wherein the resource units are in a stack, and further comprising removing resource units from the bottom of the stack.

7. A method for controlling removal of sheet articles from a stack, comprising:

(a) detecting a t level of a stack of sheet articles;

(b) identifying a predetermined second level of the stack of sheet articles, wherein the predetermined second level is lower than the first level;

(c) removing one or more sheet articles from the stack;

(d) determining an actual thickness of one or more of the sheet articles removed from the stack;

(e) determining when the stack of sheet articles reaches the predetermined second level based upon the determination of actual thickness in step (d) and a distance between the first level and the second level; and (f) selectively stopping removal of sheet articles from the stack.

8. The method of claim 7 further comprising providing a sensor for determining when the first level of the stack of sheet articles is less than a predetermined third level.

9. The method of claim 7 wherein the sheet articles are removed by removing one or more sheet articles from the bottom of the stack.

10. A system for monitoring resource units in a group, the system comprising:

(a) a container for containing a group of resource units;

(b) a measurement detector for detecting a first level of the group of resource units;

(c) a controller for identifying a predetermined second level of the group of resource units, wherein the predetermined second level is lower than the first level;

(d) a device for removing one or more of the resource units from the group; and (e) the controller further being for determining when the group of resource units reaches the predetermined second level after removal of one or more of the resource units from the group and based upon a thickness of one or more of the resource units and a distance between the first level and the second level.

11. The system of claim 10 wherein the group of resource units is a group of sheet articles in a mail insertion system.

12. The system of claim 10 wherein the controller is for determining a thickness of one or more of the resource units prior to one or more of the resource units being removed from the group.

13. The system of claim 12 wherein the measurement detector includes a sensor for determining whether the first level of the group of resource units is less than a predetermined third level.

14. The system of claim 10 further comprising a display for providing a visual display of information to an operator.

15. The system of claim 14 wherein the display provides an indication to the operator when the group of resource units is less than the predetermined second level.

16. A computer program product for monitoring resource units in a group, the computer program product comprising computer-executable instructions embodied in a computer-readable medium for performing steps comprising:

(a) detecting a first level of a group of resource units;

(b) identifying a predetermined second level of the group of resource units, wherein the predetermined second level is lower than the first level;

(c) removing one or more of the resource units from the group; and (d) determining, based upon a thickness of one or more of the resource units and a distance between the first level and the second level, when the group of resource units reaches the predetermined second level after one or more of the resource units has been removed from the group.

17. The computer program product of claim 16 further comprising detecting the first level of the group of resource units prior to any resource units being removed from the group.

18. A system for monitoring resource units in a group, comprising:

(a) a detector for detecting a first level of a group of resource units;

(b) a controller for identifying a predetermined second level of the group of resource units, wherein the predetermined second level is lower than the first level;

(c) a device for removing one or more resource units from the group;

(d) a device for determining an actual thickness of one or more of the resource units removed from the group; and (e) the controller further being for determining, responsive to the detector, when the group of resource units is below the first level, and for determining, responsive to the determination of actual thickness and a distance between the first level and the second level, when the group of resource units is below the predetermined second level.

19. The system of claim 18 wherein the group of resource units is a stack of sheet articles in a mail insertion system.

20. A method of monitoring resource units in a group, comprising:

(a) detecting a first level of a group of resource units;

(b) identifying a predetermined second level of the group of resource units, wherein the predetermined second level is lower than the first level;

(c) removing one or more of the resource units;

(d) determining when the group of resource units reaches the predetermined second level after one or more of the resource units has been removed from the group and based upon a thickness of the one or more of the resource units and a distance between the first level and the second level; and (e) wherein determining when the group of resource units reaches the predetermined second level includes:

(i) detecting when a size of the group of resource units is less than a third predetermined level;

(ii) when the size of the group of resource units is less than the third predetermined level, determining the number of resource units moved from the group; and (iii) when the number of resource units moved from the group is less than a predetermined number, indicating the group is less than the predetermined second level.

21. A method of monitoring resource units in a group, comprising:

(a) detecting a first level of a group of resource units;

(b) identifying a predetermined second level of the group of resource units, wherein the predetermined second level is lower than the first level;

(c) removing one or more of the resource units from the group;

(d) determining when the group of resource units reaches the predetermined second level after one or more of the resource units has been removed from the group and based upon a thickness of one or more of the resource units and a distance between the first level and the second level; and (e) disabling removal of resource units when the group of resource units is less than the predetermined second level.

22. A method for controlling removal of sheet articles from a stack, comprising:

(a) detecting a first level of a stack of sheet articles;

(b) identifying a predetermined second level of the stack of sheet articles, wherein the predetermined second level is lower than the first level;

(c) removing one or more sheet articles from the stack;

(d) determining an actual thickness of one or more of the sheet articles removed from the stack;

(e) determining when the stack of sheet articles reaches the predetermined second level based upon the determination of actual thickness in step (d) and a distance between the first level and the second level;

(f) selectively stopping removal of sheet articles from the stack; and (g) wherein determining when the stack of sheet articles reaches the predetermined second level includes:

(i) detecting when the level of the stack of sheet articles is less than a third predetermined level;

(ii) when the level of the stack of sheet articles is less than the third predetermined level, determining the number of sheet articles removed from the stack; and (iii) when the number of sheet articles removed from the stack is less than a predetermined number, indicating the stack is less than the predetermined second level.

23. A method for controlling removal of sheet articles from a stack, comprising:

(a) detecting a level of a stack of sheet articles;

(b) identifying a predetermined second level of the stack of sheet articles, wherein the predetermined second level is lower than the first level;

(c) removing one or more sheet articles from the stack;

(d) determining an actual thickness of one or more of the sheet articles removed from the stack;

(e) determining when the stack of sheet articles reaches the predetermined second level based upon the determination of actual thickness in step (d) and a distance between the first level and the second level;

(f) selectively stopping removal of sheet articles from the stack; and (g) disabling the moving of sheet articles when the stack of sheet articles is less than the predetermined second level.

24. A system for monitoring resource units in a group, the system comprising:

(a) a container for containing a group of resource units;

(b) a measurement detector for detecting a first level of the group of resource units;

(c) a controller for identifying a predetermined second level of the group of resource units, wherein the predetermined second level is lower then the first level;

(d) a device for removing one or more of the resource units;

(e) the controller further being for determining when the group of resource units reaches the predetermined second level after removal of one or more of the resource units from the group and based upon a thickness of one or more of the resource units and a distance between the first level and the second level; and (f) a counter for determining the number of resource units removed from the container.

25. A system for monitoring resource units in a group, the system comprising:

(a) a container for containing a group of resource units;

(b) a measurement detector for detecting a first level of the group of resource units;

(c) a controller for identifying a predetermined second level of the group of resource units, wherein the predetermined second level is lower then the first level;

(d) the controller further being for determining when the group of resource units reaches the predetermined second level after removal of one or more of the resource units from the group and based upon a thickness of one or more of the resource units and a distance between the first level and the second level;

(e) a counter for determining the number of resource units removed from the container;

(f) a device for removing resource units from the container; and (g) the controller further being adapted for indicating to the counter the removal of one or more resource units.

26. A computer program product for monitoring resource units in a group, the computer program product comprising computer-executable instructions embodied in a computer-readable medium for performing steps comprising:

(a) detecting a first level of resource units in a group of resource units;

b) identifying a predetermined second level of the group of resource units, wherein the predetermined second level is lower than the first level;

(c) removing one or more of the resource units;

(d) determining, based upon a thickness of one or more of the resource units and a distance between the first level and the second level, when the group of resource units reaches the predetermined second level after one or more resource units has been removed from the group; and (e) wherein indicating when the group of resource units reaches the predetermined second level in step (c) further includes:

(i) determining whether the number of resource units moved from the group is less than a predetermined number; and (ii) indicating that the second level of the resource units is less than the predetermined number when the number of resource units moved is less than the predetermined number.

27. A method of monitoring resource units in a group, comprising:

(a) detecting a first level of a group of resource units;

(b) identifying a predetermined second level of the group of resource units, wherein the predetermined second level is lower than the first level;

(c) removing one or more of the resource units from the group; and (d) determining when the group of resource units reaches the predetermined second level after one or more of the resource units has been removed from the group and based upon an actual thickness of one or more of the resource units and a distance between the first level and the second level.

28. A method of monitoring a group of resource units, the method comprising:

(a) providing resource units in a group stacked to a first level;

(b) grasping one or more of the stacked resource units for removal of grasped resource units from the group;

(c) determining an actual thickness of the grasped resource units while the grasped resource units are stacked to the first level; and (d) determining when the stacked resource units reach a second level based upon the determination of the actual thickness of the grasped resource units and a distance between the first level and the second level.

* * * * *